US007182335B2

(12) United States Patent
Jean-Michel et al.

(10) Patent No.: US 7,182,335 B2
(45) Date of Patent: Feb. 27, 2007

(54) METHOD OF DETECTING OVERLAPS IN A POSTAL SORTING INSTALLATION

(75) Inventors: Reboul Jean-Michel, Saint Donat (FR); Fesquet Etienne, Valence (FR); Roch Olivier, Bourg les Valence (FR)

(73) Assignee: Solystic, Gentilly Cedex (FR)

( * ) Notice: Subject to any disclaimer, the term of this patent is extended or adjusted under 35 U.S.C. 154(b) by 553 days.

(21) Appl. No.: 10/474,352

(22) PCT Filed: Jul. 10, 2003

(86) PCT No.: PCT/FR03/02183

§ 371 (c)(1),
(2), (4) Date: Oct. 9, 2003

(87) PCT Pub. No.: WO2004/007100

PCT Pub. Date: Jan. 22, 2004

(65) Prior Publication Data

US 2004/0232055 A1 Nov. 25, 2004

(30) Foreign Application Priority Data

Jul. 11, 2002 (FR) ..... 02 08738

(51) Int. Cl.
*B65H 7/02* (2006.01)

(52) U.S. Cl. ..... 271/258.01; 271/265.01; 209/584; 209/900

(58) Field of Classification Search ..... 271/258.01, 271/259, 262, 263, 265.01, 265.02, 265.04; 198/572, 810.01; 209/900, 584
See application file for complete search history.

(56) References Cited

U.S. PATENT DOCUMENTS

| | | | | |
|---|---|---|---|---|
| 3,040,866 | A | 6/1962 | Karl | |
| 3,194,552 | A | 7/1965 | Fritz | |
| 3,955,812 | A | 5/1976 | Suda et al. | |
| 3,981,493 | A * | 9/1976 | Klappenecker et al. | 271/10.05 |
| 4,733,226 | A * | 3/1988 | Kasuya et al. | 340/674 |
| 5,440,979 | A * | 8/1995 | Bonham et al. | 101/91 |
| 6,561,509 | B2 * | 5/2003 | Kettenmann et al. | 271/263 |

FOREIGN PATENT DOCUMENTS

| | | |
|---|---|---|
| DE | 27 58 007 B | 3/1979 |
| WO | WO 94/17387 | 8/1994 |

* cited by examiner

*Primary Examiner*—David H. Bollinger
(74) *Attorney, Agent, or Firm*—Sughrue Mion, PLLC

(57) ABSTRACT

The method of detecting overlapping postal items in a postal sorting installation (1) consists in detecting variation in the length of each item by causing each item to go past a plurality of proximity detectors (4, 5, 6, 7). The proximity detectors are situated at different points of the sorting installation (1) and they are configured to evaluate the length of each item. As they pass through the sorting installation, overlapping items shift progressively relative to one another due, in particular, to friction. Thus, the total length of a set of overlapping items tends to vary, such that evaluating variation in the length of each potential item serves to provide information that is reliable for detecting overlaps. Since it is relatively easy to evaluate the length of an item, the performance of the installation is improved at low cost.

11 Claims, 1 Drawing Sheet

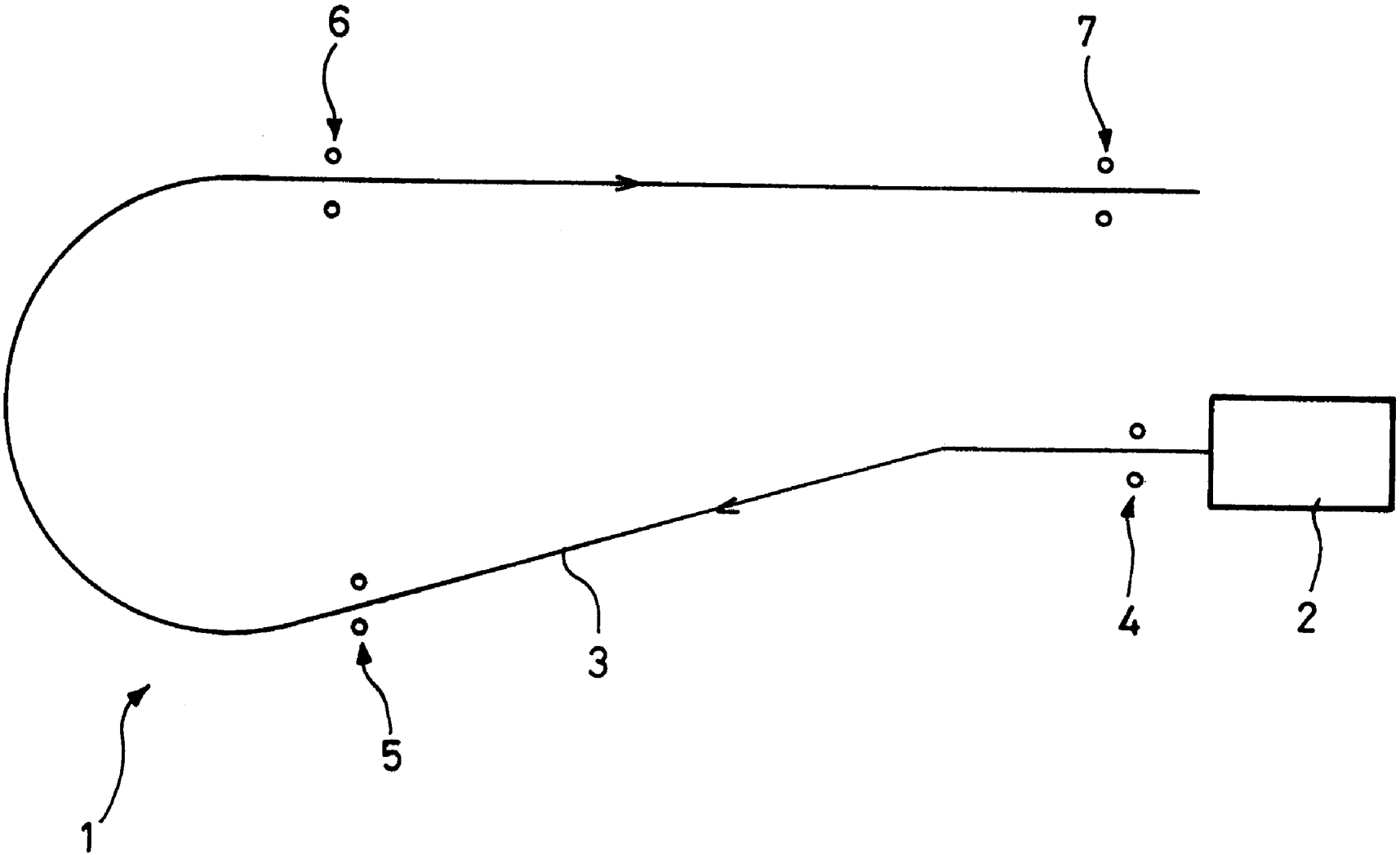
7
6
2
4
3
5
1

METHOD OF DETECTING OVERLAPS IN A POSTAL SORTING INSTALLATION

The invention relates to a method of detecting multiple overlapping postal items in a postal sorting installation. The method is more particularly designed for a postal sorting installation in which postal items are fed into the installation in the form of stacks of postal items, and in which each postal item is automatically unstacked for the purpose of being directed to a sorting outlet corresponding to the address that it bears. An unstacker situated at the inlet of the installation disposes the postal items in series one behind another on a conveyor. At the outlet of such an unstacker, or else after other steps in the sorting process, a plurality of postal items can remain stuck together, thereby forming a wad of multiple overlapping postal items. In the event that such a wad of multiple overlapping postal items is not detected in the sorting installation, all of the postal items in the wad are directed to the sorting outlet corresponding to the address borne by the postal item that masks the other items in the wad of multiple postal items. That corresponds to a destination error, after which the wrongly directed postal items must be withdrawn so as to be sorted again in a subsequent operation, thereby delaying distribution of the postal items to their addressees and inducing high processing costs. Various devices exist for mechanically separating multiple postal items, but such devices represent considerable extra cost, they tend to damage the postal items, and they are of limited reliability. Thus, detecting multiple postal items and rejecting them by directing them to a particular sorting outlet of the installation remains a preferred option for improving operation of a postal sorting installation.

Various methods exist for detecting overlaps such as, for example, the method described in patent application Ser. No. 98/11897. In that method, a digital image is acquired of the edge of each postal item in order to use image analysis to detect whether it is a single postal item or a wad of multiple overlapping postal items. Unfortunately, image analysis for distinguishing the presence of one or more items is unreliable on certain categories of mail, and therefore sometimes gives rise to detection confusion. Furthermore, such a method requires an image acquisition device to be integrated into the sorting installation, where such a device is not necessarily present because that depends on the configuration of the sorting machine. In PCT Patent Application No. 01/89724 the postal items are separated mechanically by being conveyed between a conveyor belt and a wheel provided with a brake. The wheel thus rotates at a speed slower than the speed at which the belt advances, thereby tending to separate any overlapping postal items. Unfortunately, that method requires a specific device to be integrated into the sorting installation, and that device tends to damage the postal objects. An analogous method is also disclosed in U.S. Pat. No. 3,955,812. More generally, existing methods of detecting overlaps are generally left unused because their low reliability gives rise to a large quantity of unwarranted rejects.

An object of the invention is to remedy those drawbacks by providing a detection method that is reliable and that can be implemented for a cost that is negligible.

To this end, the invention provides a method of detecting overlapping postal items in a postal sorting installation comprising a conveyor moving the items in series towards sorting outlets, said method consisting in causing each item to go past a plurality of detectors disposed along the conveyor for the purpose of detecting any variation in the length of each item, such variation in length being indicative of the presence of overlapping items, said method being characterized in that proximity detectors are used as the detectors, which proximity detectors are provided in the postal sorting installation and are connected to a management system organized to locate each postal item along the conveyor so as to synchronize the sorting operations, said management system further being programmed to perform said measurements of the length of each postal item, and to detect any variation in the length of each postal item.

As they pass through the sorting machine, overlapping items shift relative to one another, in particular due to friction which provides natural separating capacity. Thus, the overall length of a wad of overlapping items tends to vary, such that evaluating variation in the length of each potential item serves to provide information that is reliable for the purpose of detecting overlaps. Since it is relative simple to evaluate the length of an item, the performance of the installation is improved at low cost.

Advantageously, measuring the length of a postal item by using a proximity detector may consist in measuring the time taken for the item to go past the detector, or the distance traveled by the item conveyor belts while the detector is masked. The method can thus be implemented in an existing installation merely by reconfiguring the proximity detectors or by reconfiguring the management system of the sorting installation.

In a preferred implementation of the method of the invention, detection of any variation in the length of each postal item is inhibited for a predetermined duration while the sorting installation is being started up and/or while it is being stopped. Thus, the interference caused to the length measurements by any variations in conveyor speed that appear while the sorting installation is being stopped and started is avoided.

The invention is described in more detail below with reference to the accompanying drawing which shows an embodiment by way of non-limiting example.

The sole figure is a very diagrammatic view showing how the method of the invention can be implemented.

As shown diagrammatically in the sole figure, a postal sorting installation 1 includes a feed station or unstacker 2 for feeding in postal items from stacks, downstream of which unstacker a conveyor 3 and a plurality of switching stations (not shown) serve to direct each postal item towards a sorting outlet corresponding to the destination address that it bears. At the outlet of the unstacker 2, each postal item is photographed, for example, for the purpose of automatically identifying the destination address that it bears, and then it follows a time-delay path of variable length on the conveyor 3.

In the invention, the length of each postal item is measured at a plurality of points along the path so as to detect any variation in said length corresponding to an overlap. Advantageously, various proximity detectors 4, 5, 6, 7 distributed along the path followed by the postal items are connected to a management system for managing the sorting installation. Said management system centralizes the data provided by said detectors so as to calculate the variation in length of each postal item. In the example shown in the sole figure, a postal item output by the unstacker 2 is measured firstly at 4 in order to obtain a reference length which is stored in the management system. As said postal item goes past each of the other proximity detectors 5, 6, and 7, another length measurement is taken so that the management system calculates the difference between the length as measured and the reference length in order to reject the postal item if said difference is greater than a threshold value pre-recorded in the management system of the installation. The variation in length of each postal item is thus evaluated three times, at 5, 6, and 7 so as to improve measurement reliability.

As is known from the state of the art, said proximity detectors are connected to the management system of the installation so that said system accurately locates each postal item along the conveyor in order to synchronize the subsequent switching operations. More particularly, at the outlet of the unstacker, the postal items are spaced apart at irregular distances along the conveyor, so that it is essential to locate each postal item after unstacking so as to synchronize the sorting installation. In the invention, said proximity detectors may advantageously be used for taking the length measurements, thereby making it possible to implement the method on an existing sorting installation without it being necessary to add dedicated sensors. Implementing the method may thus consist merely in modifying the programming of the management system of the sorting installation.

As is known from the state of the art, the proximity detectors are generally very simple: each of them typically comprises a photoelectric cell associated with a light ray in order to provide a presence signal when a postal item masks the light signal. The appearance of a presence signal (i.e. of its leading edge) is taken into account by the management system in order to control the installation. Advantageously, the lengths of the postal items are measured using such proximity detectors by taking account both of the time for which the presence signal is emitted and of the mean speed of advance in order to deduce therefrom the length as measured.

Advantageously, measuring variation in length is inhibited by the management system on starting up and on stopping the sorting installation in order to avoid measurement errors that could give rise to unwarranted rejects. While such a sorting installation is stopping, conveyor speeds are not uniform throughout the sorting installation, with belt motion being measured at certain points only. That constitutes a major source of errors in performing length measurements. In analogous manner, starting up the installation can interfere with measuring length variations. More generally, the variation measurements are inhibited when the sorting installation stops due to a jam, or due to an emergency stop being triggered. The duration of inhibition is a predetermined duration recorded in the management system and corresponds substantially to the distance traveled by a letter between a command to stop the installation and a return to a speed deemed sufficient to be uniform all the way along the sorting installation.

When the installation includes a meter measuring the distance through which the conveyor has traveled, the length variation measurements may be inhibited as soon as a stop is triggered, and then reactivated after the installation has been started up again, and as soon as the meter has been incremented by a predetermined distance. Such a meter or "light pulse generator" is generally connected to the management system of the installation so as to inform the management system continuously of the conveyor travel position, even during transient stages such as stopping and starting. The predetermined distance during which length variation measurements are inhibited may be evaluated during tests, for example. More particularly, said distance corresponds to the distance actually traveled by the conveyor between a stop being triggered and the conveyor reaching nominal conveyor speed after starting up again.

The invention claimed is:

1. A method of detecting overlapping postal items in a postal sorting installation (1) comprising the following steps:

moving by a conveyor (3) the items in series towards sorting outlets corresponding respectively to postal addresses of the items, each item going past a plurality of proximity detectors (4, 5, 6, 7) disposed along the conveyor and connected to a management system organized to locate each postal item along the conveyor so as to synchronize sorting operations in the management system;

performing length measurements of each postal item in said management system by using said proximity detectors (4, 5, 6, 7);

detecting in said management system any variation in the length of each item, such variation in length being indicative of the presence of overlapping items.

2. The method according to claim 1, in which the detecting step of any variation in the length of each postal item is inhibited by the management system for a predetermined duration while the sorting installation is being started up or while the sorting installation is being stopped.

3. The method according to claim 2, in which the detecting step of any variation in the length of each postal item is inhibited by the management system so long as a conveyor advance counter included in the sorting installation has not been incremented with a predetermined length.

4. The method according to claim 1, in which the measuring step of the length of a postal item by using one of the proximity detectors comprises measuring the distance traveled by said item while said item is masking said proximity detector.

5. The method according to claim 1, in which the measuring step is carried out by using at least three proximity detectors distributed at three different points along the conveyor (3).

6. The method according to claim 1, in which the detecting step of any variation in the length of each postal item is inhibited by the management system for a predetermined duration while the sorting installation is being started up and while the sorting installation is being stopped.

7. A method of detecting overlapping postal items in a postal sorting installation comprising the following steps:

providing a conveyor;

providing a first proximity detector along the conveyor;

providing a second proximity detector along the conveyor downstream of the first proximity detector;

providing a management system that manages conveyance and sorting of postal items along the conveyor, wherein the first proximity detector and the second proximity detector are connected to the management system to provide information to the management system about postal items for locating the postal items along the conveyor in order to synchronism subsequent sorting of the postal items;

moving using the conveyor postal items in series towards sorting outlets corresponding respectively to a postal address for each of the items, such that each postal item passes the first proximity detector and the second proximity detector;

performing length measurements of a postal item passing by the first proximity detector and the second proximity detector;

detecting with the management system any variation in the length of the postal item passing by the first proximity detector and the second proximity detector based on the length measurements; and interpreting with the management system a variation in length of the postal item passing by the first proximity detector and the second proximity detector as indicative of the presence of overlapping items.

8. The method of detecting overlapping postal items according to claim 7, wherein overlapping postal items conveyed on the conveyor are separated without applying a braking roller disposed along the conveyor between the first proximity detector and the second proximity detector.

9. The method of detecting overlapping postal items according to claim 7, wherein overlapping postal items conveyed on the conveyor are separated without applying a roller contacting the overlapping postal items from above.

10. The method of detecting overlapping postal items according to claim 7, wherein overlapping postal items conveyed on the are separated without applying a mechanism disposed along the conveyor between the first proximity detector and the second proximity detector, the mechanism being one that frictionally contacts the overlapping postal items to thereby apply a breaking force relative to the conveyor moving direction.

11. The method of detecting overlapping postal items according to claim 7, further comprising the step of providing a third proximity detector downstream of the second proximity detector, and wherein the steps of performing length measurements of the postal item and detecting any variation in the length of the postal item is also based on information that the management system receives by the third proximity detector.

* * * * *